United States Patent [19]

Salter

[11] Patent Number: 4,948,296

[45] Date of Patent: Aug. 14, 1990

[54] SWIMMING POOL CONSTRUCTION

[75] Inventor: Tom Salter, New South Wales, Australia

[73] Assignee: Huntina Pty. Ltd., New South Wales, Australia

[21] Appl. No.: 135,023

[22] Filed: Dec. 18, 1987

[51] Int. Cl.[5] ..... B28B 1/16; E02D 27/00; E04B 1/16; E04H 4/02

[52] U.S. Cl. ..... 405/55; 4/506; 52/169.7; 52/742; 264/34; 264/35; 264/256; 405/268; 405/270

[58] Field of Search ..... 52/169.7, 747, 742; 428/426, 446, 413, 404; 264/31, 34, 35, 256, 257, 259, 333; 4/506; 405/268, 270, 52, 55

[56] References Cited

U.S. PATENT DOCUMENTS

| | | | |
|---|---|---|---|
| 2,887,759 | 5/1959 | Brownell, Jr. | 264/31 X |
| 3,468,088 | 9/1969 | Miller | 264/316 X |
| 3,745,738 | 7/1973 | Singer | 264/34 X |
| 3,922,413 | 11/1975 | Reineman | 264/256 X |
| 3,968,191 | 7/1976 | Stegmeier | 264/34 |
| 4,106,246 | 8/1978 | LaFountaine | 52/169.7 |
| 4,141,187 | 2/1979 | Graves | 52/309.3 X |
| 4,142,337 | 3/1979 | Holcomb | 264/35 X |
| 4,168,924 | 9/1979 | Draper et al. | 52/663 X |
| 4,213,929 | 7/1980 | Dobson | 264/317 X |
| 4,224,265 | 9/1980 | Pfisterer | 264/256 X |
| 4,257,481 | 3/1981 | Dobson | 52/220 X |
| 4,263,759 | 4/1981 | Miller | 264/46.6 X |
| 4,374,078 | 2/1983 | Richardson | 264/35 |

FOREIGN PATENT DOCUMENTS

| | | |
|---|---|---|
| 122210 | 8/1978 | Australia . |
| 137875 | 1/1980 | Australia . |
| 176078 | 4/1982 | Australia . |
| 82521 | 4/1983 | Australia . |
| 14103 | 11/1983 | Australia . |
| 27149 | 10/1984 | Australia . |
| 36850 | 7/1985 | Australia . |

*Primary Examiner*—Jan H. Silbaugh
*Assistant Examiner*—Karen D. Kutach
*Attorney, Agent, or Firm*—John P. White

[57] ABSTRACT

A method of constructing a swimming pool by laying a concrete shell of 80 mm thickness without any substantial reinforcement. A glass reinforced plastic of 5 mm thickness is then laid over the concrete once the concrete has cured. This particular combination between the fiberglass and the concrete shell allows the shell to crack and move in relation to the reinforced plastic layer, without transmitting any stresses to the reinforced plastic layer. This results in a pool which allows any stresses due to soil subsidence, movement, etc. to be transmitted to the concrete shell and not the reinforced plastic layer thereby leaving the plastic layer free of cracks.

3 Claims, 1 Drawing Sheet

SWIMMING POOL CONSTRUCTION

FIELD OF THE INVENTION

The present invention relates to a new composite material and structures made from said composite material. In particular, the new composite material has been found to be particularly applicable to swimming pools. Although the following description specifically describes a swimming pool embodiment, it will be realised by those skilled in the art that where a water sealed structure is required the composite material of the present invention will have applications.

DESCRIPTION OF PRIOR ART

It is known, in the prior art, to build in-situ water retaining structures such as swimming pools using reinforced concrete. In this type of swimming pool, a reinforced concrete structure is designed and constructed such that it will carry the anticipated structural loads to be imposed thereon with a predetermined over capacity or factor of safety against failure due to overloading. The ability of a structure to withstand the anticipated structural loads and to still retain a predetermined structural over capacity or safety factor against failure will be referred to hereinafter as meeting the load carrying requirements of the particular structure.

The construction of a reinforced concrete swimming pool requires the preparation of an appropriate cavity in the ground approximately defining the exterior dimensions of the structure, careful placement of steel reinforcement along the cavity surface and spraying of the cavity surface with an appropriate concrete mix. As concrete is a relatively porous material and is often considered to be an aesthetically unsightly material, reinforced concrete pools are usually lined with either ceramic tiles, paints or a thin, non-structural layer of glass reinforced plastics.

It will be noted that construction of a swimming pool in reinforced concrete is a relatively expensive operation. The structural strength of the structure is dependent on the use of steel reinforcement materials and special finishing of the interior surface is required in order to achieve a non-porous and aesthetically acceptable structure.

It is also known to prefabricate a swimming pool structure from moulded glass reinforced plastics which is designed and manufactured to meet the load carrying requirements of the swimming pool. To install such a swimming pool, a cavity is prepared to receive the glass reinforced plastics structure and is lined with a layer of a sand cement mixture. When the glass reinforced plastics structure is placed in the cavity the granular sand/cement layer deforms under contact pressure ensuring that there are no unfilled gaps between the swimming pool structure and the surrounding soil. As the cement in the sand/cement mixture will eventually react with moisture from the surrounding soil and harden, this method provides a uniform foundation layer for the structure.

Although in many situations such a glass reinforced plastics structure is cheaper than reinforced concrete, it can be a difficult and expensive operation to transport the glass reinforced structure from the place of manufacture to the actual site. Privately owned, domestic swimming pools are usually installed at a location behind the owners house and away from the street, which while providing privacy, can present considerable access problems.

The swimming pool structure often needs to be lifted by a crane from a vehicle at the front of the house to the prepared site at the rear of the house. Depending on the distance from the transport vehicle to the proposed site, the size of the house and other obstacles such as trees and power lines such a relocation can be a very difficult and expensive operation which may be impossible, in certain situations, to perform.

BRIEF SUMMARY OF THE INVENTION

Therefore, the present invention seeks to provide a composite material structure which allows at least some of the deficiencies of the prior art to be ameliorated.

According to a first aspect of the present invention there is provided a composite material comprising:

a layer of concrete which contains minimal or no reinforcement and a layer of glass reinforced plastics material bonded to said concrete.

According to a second aspect of the present invention there is disclosed a composite structure comprising:

an outer layer of concrete which contains minimal or no reinforcement, said outer layer having insufficient structural strength to meet the load carrying requirements of said structure, an inner layer of glass reinforced plastics bonded to said outer layer, the combined structural strength of said inner and outer layers being sufficient to meet the load carrying requirements of said structure.

According to a third aspect the present invention there is disclosed a method of making a composite structure comprising:

forming an outer layer of concrete containing minimal or no reinforcement having insufficient structural bonded strength to meet the load carrying requirements of said structure, forming an inner layer of glass reinforced plastics bounded to said outer layer, where the combined structural strength of said inner and outer layers is sufficient to meet the load carrying requirements of said structure.

BRIEF DESCRIPTION OF DRAWINGS

The present invention will now be further explained by reference to the attached drawing in which.

DETAILED DESCRIPTION OF DRAWINGS

Figure 1:
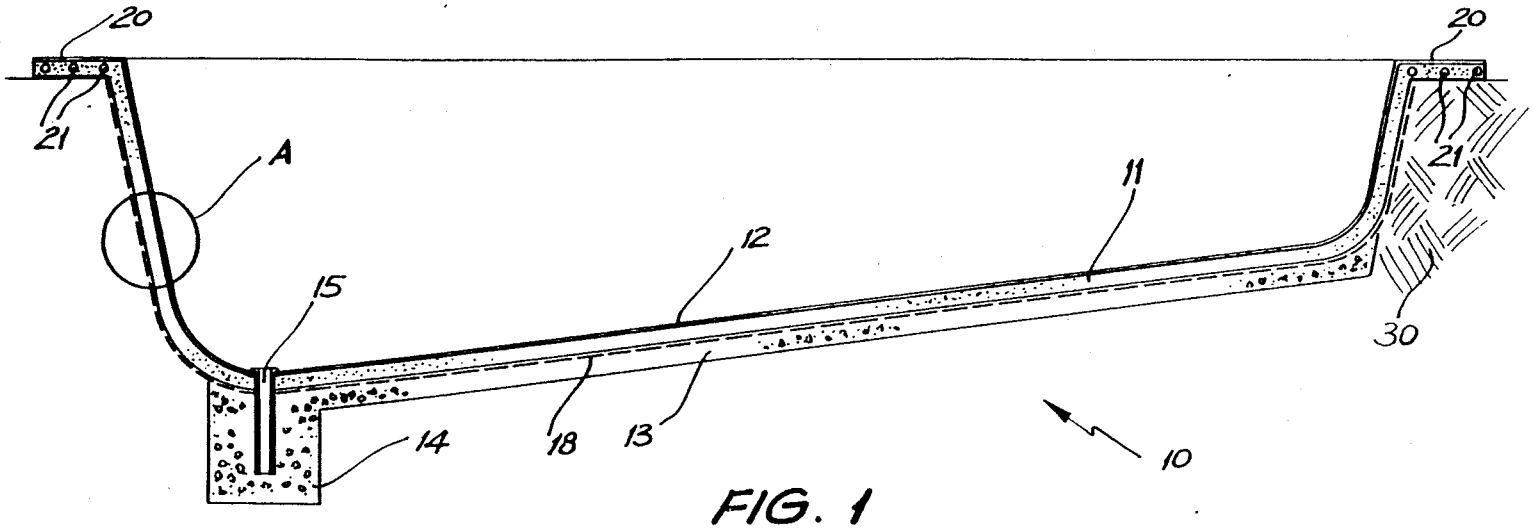
FIG. 1 is a longitudinal cross-section of a swimming pool embodying the present invention.
Figure 2:
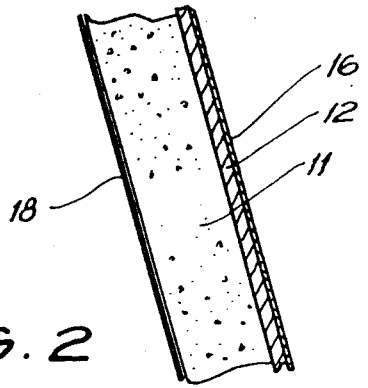
FIG. 2 is a detail A of FIG. 1.

FIG. 1 illustrates a swimming pool structure, generally designated by the numeral 10, which is a preferred embodiment of the present invention. The preferred structure comprises an outer layer of concrete 11 which is unreinforced, although other embodiments may include minimal reinforcement, and an inner layer of glass reinforced plastic 12, "minimal" is used here to mean of no structural significance. Although not discernable in FIG. 1, the preferred structure also includes a gel or finishing coat 16 on the exposed surface of the glass reinforced coating 12 as illustrated in FIG. 2.

It is well known that concrete has little or no strength in tension and therefore generally provides little structural strength without some degree of reinforcement. The concrete coating of the preferred embodiment has a minimum thickness of 80 mm and, as this layer is unreinforced, it will be clear to a skilled artisan that such a concrete layer, acting by itself, will not be capable of meeting the load carrying requirements of a swimming pool. However, by combining a layer of glass reinforced plastics 12 with the concrete layer 11 it is possible to produce a structure wherein the combined structural strength of the layers is sufficient to meet the load carrying requirements of a swimming pool.

To construct a swimming pool such as that illustrated in FIG. 1, a cavity is prepared in the ground having dimensions which at least approximately define the outside dimensions of the structure. It is preferred that a coarse aggregate drainage blanket 13 be provided in the bottom thereof with a rubble pit 14 at the lower end to facilitate dewatering during construction and to allow for the operation of a hydrostatic valve 15 in the finished structure.

The surface of the prepared cavity is then covered with an impermeable membrane 18 and the inside surface of the cavity is sprayed with concrete until a layer of the desired thickness is produced. As stated above, it has been found that a concrete layer of a minimum thickness of 80mm is adequate.

The concrete layer should be allowed to cure before the glass reinforced plastics layer is applied and it has been found that a curing period of fourteen days is sufficient for this purpose. Any cracks of greater than 1mm width should be veed out and filled with an epoxy resin and the entire exposed concrete surface treated with a resin sealer. The interior surface can then be lined with the layer of glass reinforced plastics. It has further been found that if a glass reinforced plastics layer 11 of 5mm thickness is applied to a concrete layer 11 of a minimum of 80mm thickness, the total structural strength is sufficient to meet the load carrying requirements of a swimming pool. Finally, the glass reinforced plastics layer is treated to remove sharp projections or rough edges and the finishing or gel coat is applied thereto.

It should be noted that the preferred embodiment also includes a concrete annular stiffener 20, which is reinforced by steel bars 21. Also in many instances steps may also be required and these could also be made using reinforced concrete. These are features common to the prior art and therefore are not part of the present invention as such.

Water retaining structures embodying the present invention have been found to have the following benefits over the prior art:

1. Freedom of shape—The shape of pre-moulded fibreglass pools are limited to the moulds available. Structures embodying the present invention can be made to almost any shape desired.

2. Flexibility—the conventional reinforced concrete pool is relatively stiff and any movement or distortion of the surrounding soil can cause cracks to occur in the shell. Also shrinkage and thermal stresses quite often cause cracks to occur in the concrete shell. In the long term, these cracks could allow water to come into contact with the steel reinforcement and this could result in a gradual deterioration of the reinforced concrete shell. Structures embodying the present invention have the flexibility of a fibreglass pool. Movements of the soil 30 surrounding the structure may cause deformations to occur in the walls and floor thereof but these would not cause cracks to appear in a 5mm thick fibreglass lining. The fibreglass lining 12 is much more flexible and elastic than the unreinforced concrete backing 11. Ground movements, drying shrinkage or other factors may cause cracks to appear in the concrete backing shell but these will not propagate into the fibreglass lining. Laboratory tests indicate that the bond strength between the fibreglass and the concrete is much weaker than the tensile strength of the fibreglass. The tests also indicated that quite large deflections can occur in the composite material without any damage occurring to the fibreglass lining.

3. Strength—the composite action of the fibreglass lining 12 with the concrete backing 11 has resulted in a structure that is stronger than the normal pre-moulded fibreglass shell. This extra strength is present and was clearly indicated by laboratory tests. The tests also showed that, provided the stresses were kept within acceptable limits, cyclic loading did not effect the bond strength between the fibreglass lining and the concrete backing. Cyclic loading does not normally occur in for example ingrown swimming pools.

4. Interior finish—common types of interior finishes to reinforced concrete swimming pools are marble-dust and white cement render, ceramic tiles, special paints and vinyl ester coatings. These generally perform well but in many instances there are problems associated with the interior finish, especially with staining, cracking and cleaning of the surface. The preferred embodiment has a hard gel-coat 20 interior finish which has performed well. Swimming pools of the preferred embodiment have the same finish as the prior art pre-moulded fibreglass pools.

5. Easier construction and better quality control—the prior art pre-moulded fibreglass pool is manufactured in a factory, transported to site and has to be placed in position with a crane. It then is levelled and backfilled with a sand/cement mixture which is normally mixed on site. After completion of the backfill, the reinforced concrete concourse is formed and poured. Some of the common problems that can occur in the installation of pre-moulded fibreglass pools are:

a. Hole is over excavated or incorrectly shaped.
b. Sand bedding is not to the correct profile. This makes it difficult to level the pool shell.
c. The sand/cement backfill is incorrectly mixed and placed.
d. The fill material below sections of the concourse is not properly compacted or piered. In the construction of reinforced concrete pools the construction time is often slowed down by the time taken to place the reinforcement and to obtain approval from the appropriate Government body or Engineer for the reinforcement. This situation can be aggravated if rainfall occurs during this period and the pool excavation fills with water or the base of the excavation deteriorates and requires cleaning. The present invention has significantly eliminated the problems mentioned above and will speed up the construction process. With good coordination the hole can be excavated and the concrete backing 11 placed within one or two days.

6. Limitations—structures incorporating the present invention are not suitable for all sites. In general, the standard design would be suitable for Class A, S and M sites as defined in Australian Standard No. AS2870, provided that the natural groundwater table is not located more than one half of the maximum depth up the wall of the structure. The purpose of the laboratory tests performed was:

a. To investigate the composite behaviour of the fibreglass/concrete material.

b. To determine indicative values of the flexural and bond strengths of the material.
c. To investigate the mode of failure under flexural loads.
d. To confirm the tensile and compressive properties of the fibreglass material
e. To investigate the behaviour of the material under cyclic loading.
f. To investigate the effects on the flexural strength of the material after pre-cracking the concrete.

The most important result of the laboratory tests was the clear confirmation that the bond strength between the fibreglass and the concrete was much weaker than the tensile or compressive strength of the fibreglass. This means that the fibreglass shell 12 would remain intact long after the concrete backing 11 has cracked and the bond strength has totally failed. Another important result is the confirmation that a flexural failure of the composite material would not result in a failure of the fibreglass shell. This would mean that should excessive external soil pressures cause a large deflection to occur in the pool wall, the fibreglass shell would not crack or fail. The bulged section of the wall would need to be removed and reconstructed but the failure would only be local and the repair could be quickly carried out. When a similar type of failure occurs in a pre-moulded fibreglass pool, quite often the whole shell needs to be removed and the entire backfill must be reinstated Sometimes the fibreglass shell also needs to be re-shaped in the affected area.

Although the invention has been described above with reference to preferred embodiment, it will be appreciated that numerous variations, modifications or alternatives may be made without departing from the spirit or scope of the invention as broadly described.

We claim:

1. A method of constructing a swimming pool of a concrete layer and a glass reinforced plastic layer comprising:

(a) excavating a suitable pool cavity having a surface;

(b) casting in situ the concrete layer wherein the casting is accomplished by applying a concrete composition having minimal reinforcement, which reinforecement provides no structural significance to the concrete layer, to the surface of the cavity, the concrete layer being at least 80mm thick and incapable of meeting load carrying requirements of the swimming pool;

(c) allowing the concrete layer to cure thereby providing for a weak bond strength between the cured concrete layer and the layer of glass reinforced plastic applied thereto; and then (d) applying in situ to the cured concrete layer the layer of glass reinforced plastic having a thickness of 5mm such that the bond strength between the layer of glass reinforced plastic and the cured concrete layer is weaker than the tensile or compressive strength of the layer of glass reinforced plastic so that cracks caused in the cured concrete layer by ground movements and drying shrinkage are not propagated to the layer of glass reinforced plastic due to the weaker bond strength between the layer of glass reinforced plastic and the cured concrete layer, and such that the combined structural strength of the concrete layer and the layer of glass reinforced plastic is sufficient to meet the load carrying requirements of the swimming pool.

2. A method according to claim 1, wherein the concrete layer is allowed to cure for at least 14 days before the glass reinforced plastic layer is applied.

3. A method according to claim 2, wherein the concrete layer is sealed on an inner surface thereof before the glass reinforced plastic layer is applied.

* * * * *